US008740561B2

(12) United States Patent
Cappuccini et al.

(10) Patent No.: US 8,740,561 B2
(45) Date of Patent: Jun. 3, 2014

(54) JACKET IMPELLER WITH FUNCTIONAL GRADED MATERIAL AND METHOD

(75) Inventors: Filippo Cappuccini, Florence (IT); Massimo Giannozzi, Florence (IT); Gabriele Masi, Florence (IT); Federico Iozzelli, Florence (IT)

(73) Assignee: Nuovo Pignone S.p.A., Florence (IT)

( * ) Notice: Subject to any disclaimer, the term of this patent is extended or adjusted under 35 U.S.C. 154(b) by 665 days.

(21) Appl. No.: 13/078,466

(22) Filed: Apr. 1, 2011

(65) Prior Publication Data

US 2011/0286855 A1 Nov. 24, 2011

(30) Foreign Application Priority Data

May 18, 2010 (IT) ..... CO2010A0028

(51) Int. Cl.
*F01D 5/28* (2006.01)

(52) U.S. Cl.
USPC ..... 415/217.1; 416/241 R

(58) Field of Classification Search
USPC ..... 415/217.1; 29/889
See application file for complete search history.

(56) References Cited

U.S. PATENT DOCUMENTS

| | | | | |
|---|---|---|---|---|
| 4,428,717 | A * | 1/1984 | Catterfeld | 415/217.1 |
| 4,529,452 | A | 7/1985 | Walker | |
| 4,554,130 | A | 11/1985 | Ecer | |
| 4,746,554 | A | 5/1988 | Ecer | |
| 4,787,821 | A | 11/1988 | Cruse et al. | |
| 4,900,635 | A | 2/1990 | Bowen et al. | |
| 5,593,085 | A | 1/1997 | Tohill et al. | |
| 7,316,057 | B2 | 1/2008 | Seth | |
| 7,537,725 | B2 | 5/2009 | Groh et al. | |
| 2006/0083653 | A1 | 4/2006 | Das | |
| 2007/0272350 | A1 | 11/2007 | Voice et al. | |
| 2009/0110556 | A1 | 4/2009 | Jahnz et al. | |
| 2009/0176110 | A1 | 7/2009 | Pabla et al. | |

FOREIGN PATENT DOCUMENTS

| | | | |
|---|---|---|---|
| DE | 3032593 | A1 | 4/1981 |
| EP | 0184934 | A1 | 6/1988 |

* cited by examiner

*Primary Examiner* — Richard Edgar
(74) *Attorney, Agent, or Firm* — Global Patent Operation

(57) ABSTRACT

Devices and methods provide for an impeller for use in a compressor. A method for manufacturing the impeller includes: attaching an intermediate layer to a base metal by placing a first metal powder into a gap between a first insert and the base metal; processing with hot isostatic pressing the base metal, the first metal powder and the first insert such that the intermediate layer is bonded to the base metal; attaching an external layer to the intermediate layer by placing a second powder into a gap between a second insert and the intermediate layer; processing the base metal, the intermediate layer, the second metal powder and the second insert via hot isostatic pressing such that the external layer is bonded to the intermediate layer; and removing the second insert to form the impeller, wherein the external layer is corrosion resistant.

10 Claims, 9 Drawing Sheets

JACKET IMPELLER WITH FUNCTIONAL GRADED MATERIAL AND METHOD

TECHNICAL FIELD

The embodiments of the subject matter disclosed herein generally relate to compressors and more particularly to impellers made with functional graded material.

BACKGROUND

A compressor is a machine which accelerates the particles of a compressible fluid, e.g., a gas, through the use of mechanical energy to, ultimately, increase the pressure of that compressible fluid. Compressors are used in a number of different applications, including operating as an initial stage of a gas turbine engine. Among the various types of compressors are the so-called centrifugal compressors, in which the mechanical energy operates on gas input to the compressor by way of centrifugal acceleration which accelerates the gas particles, e.g., by rotating a centrifugal impeller through which the gas is passing. More generally, centrifugal compressors can be said to be part of a class of machinery known as "turbo machines" or "turbo rotating machines".

Centrifugal compressors can be fitted with a single impeller, i.e., a single stage configuration, or with a plurality of impellers in series, in which case they are frequently referred to as multistage compressors. Each of the stages of a centrifugal compressor typically includes an inlet conduit for gas to be accelerated, an impeller which is capable of providing kinetic energy to the input gas and a diffuser which converts the kinetic energy of the gas leaving the impeller into pressure energy.

FIG. 1 schematically illustrates a multistage, centrifugal compressor 10. Therein, the compressor 10 includes a box or housing (stator) 12 within which is mounted a rotating compressor shaft 14 that is provided with a plurality of centrifugal impellers 16. The rotor assembly 18 includes the shaft 14 and impellers 16 and is supported radially and axially through bearings 20 which are disposed on either side of the rotor assembly 18.

The multistage centrifugal compressor 10 operates to take an input process gas from duct inlet 22, to accelerate the particles of the process gas through operation of the rotor assembly 18, and to subsequently deliver the process gas through outlet duct 24 at an output pressure which is higher than its input pressure. Between the impellers 16 and the bearings 20, sealing systems 26 are provided to prevent the process gas from flowing to the bearings 20. The housing 12 is configured so as to cover both the bearings 20 and the sealing systems 26 to prevent the escape of gas from the centrifugal compressor 10. Also seen in FIG. 1 is a balance drum 27 which compensates for axial thrust generated by the impellers 16, the balance drum's labyrinth seal 28 and a balance line 29 which maintains the pressure on the outboard side of the balance drum 27 at the same level as the pressure at which the process gas enters via duct 22.

Various types of process gasses may be used in the multistage centrifugal compresses. For example, the process gas maybe any one of carbon dioxide, hydrogen sulfide, butane, methane, ethane, propane, liquefied natural gas, or a combination thereof. When operating with a corrosive process gas, centrifugal compressors can employ impellers which are composed of corrosion resistant alloys, e.g., stainless steels, nickel based super alloys and titanium alloys. However, the materials used in these corrosion resistant alloys tend to be expensive.

Attempts at alternative solutions have also included the use of coatings to improve corrosion resistance and attaching a cladding layer to counteract stress corrosion cracking. However, these methods have not been shown to be effective on the flow path parts of an impeller due to the complexity of the geometry, which can result in partial or no coverage, and because of the deformation caused to the impeller when applying the cladding.

Accordingly, systems and methods for reducing costs while maintaining acceptable material properties for such working environments are desirable.

SUMMARY

According to an exemplary embodiment there is a method for manufacturing an impeller to be used by a compressor. The method includes attaching an intermediate layer to a base metal by placing a first metal powder into a gap between a first insert and the base metal; processing with hot isostatic pressing the base metal, the first metal powder and the first insert such that the intermediate layer is bonded to the base metal, the intermediate layer having a porosity of generally less than one percent, wherein a coefficient of thermal expansion of the intermediate layer is between a coefficient of thermal expansion for the base metal and an external layer; removing the first insert; attaching an external layer to the intermediate layer by placing a second powder into a gap between a second insert and the intermediate layer; processing the base metal, the intermediate layer, the second metal powder and the second insert via hot isostatic pressing such that the external layer is bonded to the intermediate layer, the external layer having a porosity of generally less than one percent; and removing the second insert to form the impeller, wherein the external layer is corrosion resistant after the hot isostatic pressing.

According to another exemplary embodiment there is a method for manufacturing an impeller to be used by a compressor. The method includes attaching a first layer to an insert, wherein the first layer is corrosion resistant after hot isostatic pressing; attaching a second layer to the first layer, wherein a coefficient of thermal expansion of the second layer is between a coefficient of thermal expansion for a base metal and the first layer; attaching a combination of the insert, the first layer and the second layer to the base metal such that the second layer and the base metal are in contact; processing the insert, the first layer, the second layer and the base metal via hot isostatic pressing such that the second layer is bonded to the base metal, the first layer and the second layer are bonded and both the first layer and the second layer have a porosity of generally less than one percent; and removing the insert to form the impeller.

According to another exemplary embodiment there is an impeller for use in a compressor. The impeller includes a disk section which is made from a carbon steel; a counter disk section which is made from the carbon steel; a plurality of blades made from the carbon steel in contact with the disk section and the counter disk section; an intermediate layer attached on surfaces which are in the corrosive process gas flow path of the disk section, the counter disk section and the plurality of blades, wherein the intermediate layer is attached via a hot isostatic pressing, resulting in a porosity of generally less than one percent and a coefficient of thermal conductivity between a coefficient of thermal conductivity for the carbon steel and an external layer; and an external layer attached to the intermediate layer via a hot isostatic pressing, the external layer having a porosity less than once percent after hot isostatic pressing and being corrosion resistant.

BRIEF DESCRIPTION OF THE DRAWINGS

The accompanying drawings illustrate exemplary embodiments, wherein.

DETAILED DESCRIPTION

The following detailed description of the exemplary embodiments refers to the accompanying drawings. The same reference numbers in different drawings identify the same or similar elements. Additionally, the drawings are not necessarily drawn to scale. Also, the following detailed description does not limit the invention. Instead, the scope of the invention is defined by the appended claims.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

Figure 2:
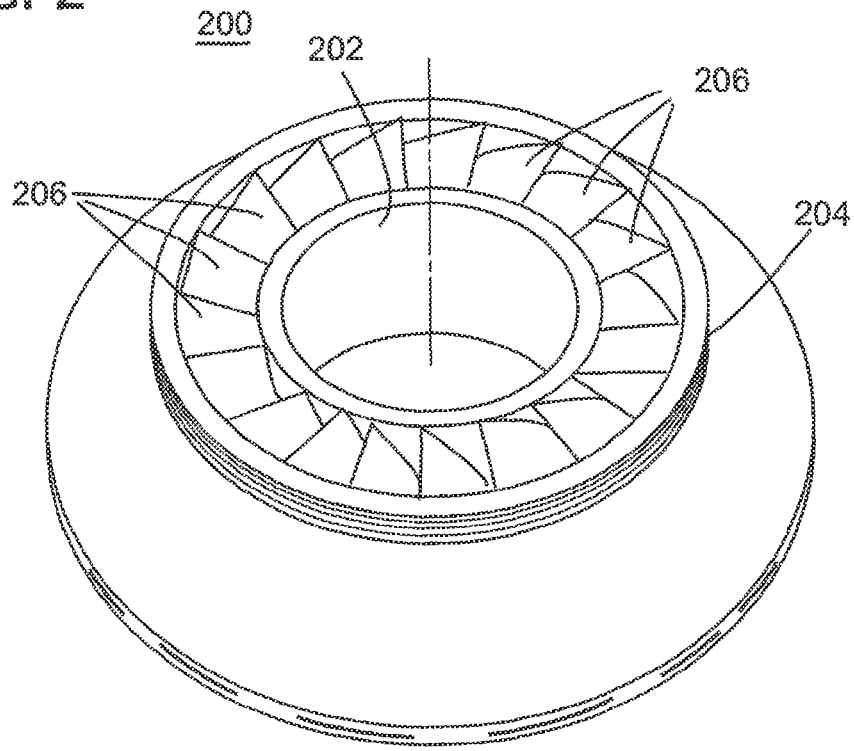
FIG. 2 illustrates a jacket impeller according to exemplary embodiments.

As described in the Background section, compressors can use a process gas which may be corrosive. For example, the process gas maybe any one of carbon dioxide, hydrogen sulfide, butane, methane, ethane, propane, liquefied natural gas, or a combination thereof. The impeller rotates and provides kinetic energy to the process gas and thus has surfaces which are exposed to the process gas. In the cases where the process gas is corrosive, the impeller has traditionally been fully manufactured from a corrosion resistant alloy. However, the materials used for this are expensive. Exemplary embodiments described herein provide systems and methods for manufacturing an impeller with a smaller amount of the expensive corrosion resistant alloys, which reduces the cost of the impeller, while still maintaining the desired material properties. An exemplary impeller is shown in FIG. 2.

According to exemplary embodiments, the impeller 200 includes a disk section 202, a counter disk section (also known as a shroud) 204 and a plurality of blades 206. The corrosive process gas flows between the plurality of blades and an area bounded by the outer surface of the disk section 202 and an interior surface of the counter disk section 204. Therefore these surfaces need protection from corrosive process gasses while the unexposed surfaces and interior portions do not need this protection. According to exemplary embodiments, a base metal, e.g., a carbon steel (which is less expensive than a corrosion resistant material), can be used as a base for an impeller, with corrosion resistant alloys being attached to the base as desired to obtain the desired material properties. For example, centrifugal compressor impellers can be manufactured by using functionally graded materials on top of the base metal to enhance the corrosion and erosion protection of alloys in the affected areas, e.g., the flow path of the process gas and the blade edges. Corrosion is generally used herein to describe corrosion, erosion and to describe other similar materially degrading environments caused by process gasses, e.g., to avoid sulfide stress cracking which can occur in sour and acid gas compression, that would be applicable to the impeller.

Figure 3:
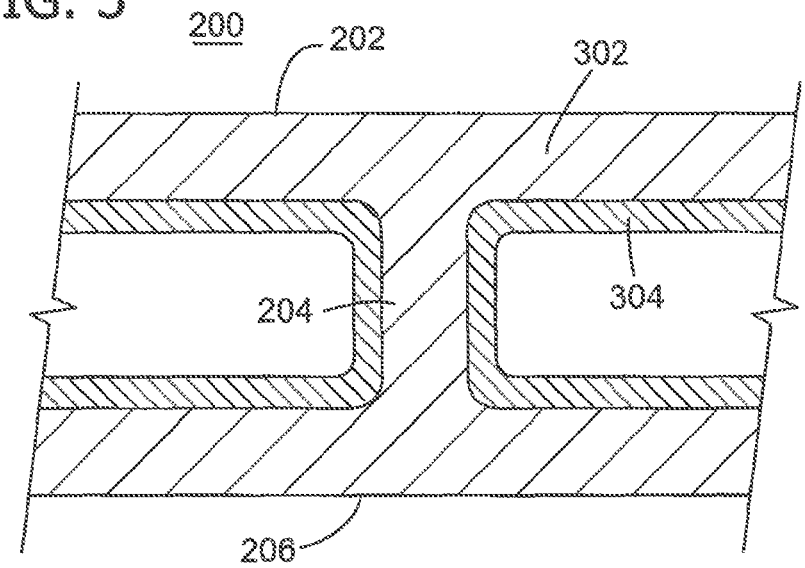
FIG. 3 shows an integrated disk, blade and counter disk with an external layer according to exemplary embodiments.

According to exemplary embodiments, the impeller 200 can be made from a single integrated base metal 302 and have a protective alloy 304, made from one or more joined layers, attached to the impeller 200 over the affected areas as shown in FIG. 3. According to exemplary embodiments, as can be seen in FIG. 3, there is a reduction in the amount of the expensive corrosion resistant (and/or erosion resistant) protective alloy 304 used as compared to a traditional impeller which would use only the protective alloy 304 for the entire impeller. As shown in FIG. 3, there are only two different material layers, the base metal layer 302 and the protective alloy layer 304. The base metal 302 which forms the skeleton of the impeller 200 can be manufactured by using various conventional processes, e.g., stamping, machining and the like, or through a powdered metal hot isostatic pressing process. The protective alloy, which is the final or exterior layer, can be applied using powder metal techniques, e.g., hot isostatic pressing, to achieve the final dimension desired of the impeller 200. However, in some cases, the thermal coefficient of expansion is significantly different between the base metal layer 302 and the protective alloy layer 304 such that failures occur due to the thermal expansion mismatch and the potential stress generated during service. According to exemplary embodiments, multiple layers or a layer with an acceptable gradient with respect to thermal and mechanical properties can be manufactured to be added to the impeller for use in these corrosive environments.

Figure 4:
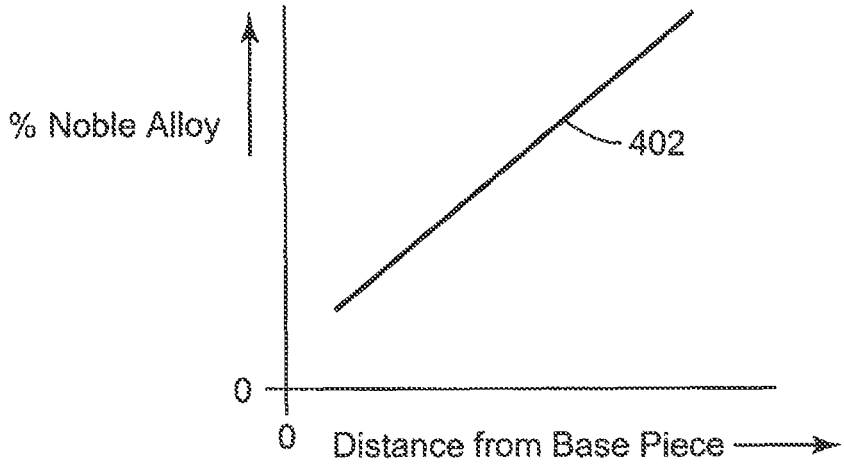
FIG. 4 illustrates a gradient for a functionally graded material according to exemplary embodiments.

Prior to describing other exemplary embodiments, a brief description of functionally graded materials and an exemplary manufacturing process is now presented. Functionally graded materials are materials in which the structure and composition can be changed over a thickness of a structure. For example, a nickel super-alloy can have a 5% composition in a metal matrix at one end, and a 20% composition in the metal matrix at another end. This can be achieved by changing the composition of a powdered metal gradually when filling a mold. This can allow material properties to gradually change without inducing an undesirable property, e.g., excessive thermal stress or expansion. An example of a gradient that can represent the change of a material property, e.g., coefficient of thermal expansion, in a functionally graded material is shown in FIG. 4, wherein as the thickness increases (as shown by the distance from the base piece) the percentage of a noble alloy, e.g., a nickel super-alloy, increases resulting in the gradual continuous change of the coefficient of thermal expansion 402. While the curve 402 is shown as a straight line, various other curves can represent the actual change depending upon the property and the percentage of noble alloy (or other material) added.

Figure 5:
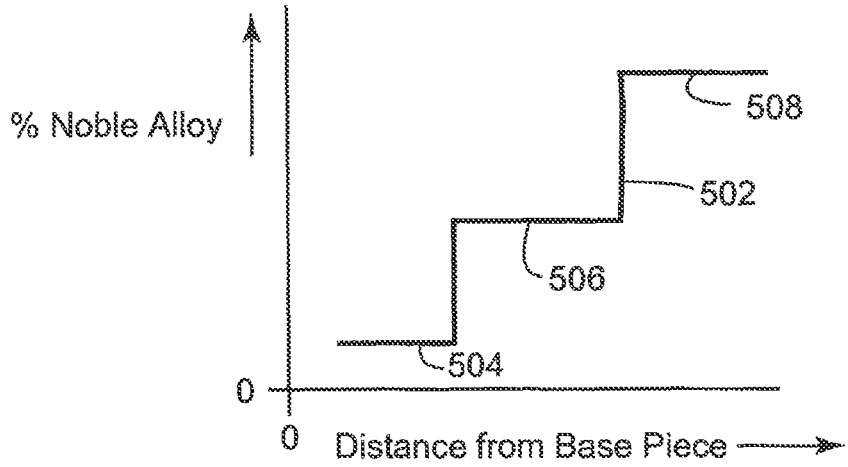
FIG. 5 shows layered steps for a functionally graded material according to exemplary embodiments.

According to another exemplary embodiment, the functionally graded material can be applied in layers in which each layer has a different percent of the desired material being added. An example of multiple layers, or steps, is shown in FIG. 5. In this example, the curve 502 shows three distinct layers 504, 506 and 508 each of which has a different distance from the base piece. Additionally, each step 504, 506 and 508 has a different relatively constant percentage of noble alloy in each layer giving each layer different material properties. This layering allows for the control of properties, e.g., thermal expansion, as desired, as well as allowing for the last or external layer to have the material properties, e.g., corrosion resistance, desired for the impeller 200 application. According to exemplary embodiments, examples of materials, i.e., noble alloys, which can be used as functionally graded materials include stainless steels, nickel super-alloys, cobalt super-alloys, titanium alloys, tungsten carbide embedded in a cobalt or nickel matrix, or other metal materials which result in the desired material properties. Other material examples include: Alloy 625, Alloy 725, WC with approximately 17 percent Co, an approximately 86 percent WC matrix with approximately 10 percent Co and approximately 4 percent Cr and Ti 6246.

According to exemplary embodiments, the functionally graded material and layers of the functionally graded material can be joined to a base metal using a hot isostatic pressing (HIP) process. HIP is a manufacturing process that occurs at a high temperature, under pressure in a high pressure containment vessel in an inert gas atmosphere, e.g., argon. An inert gas is used so that no chemical reaction occurs with the materials when HIP occurs. HIP creates a reduction in the porosity in metals which can allow for improving a material's mechanical properties. HIP can be used for both forming and joining components, often by using a metal powder.

Figure 6:
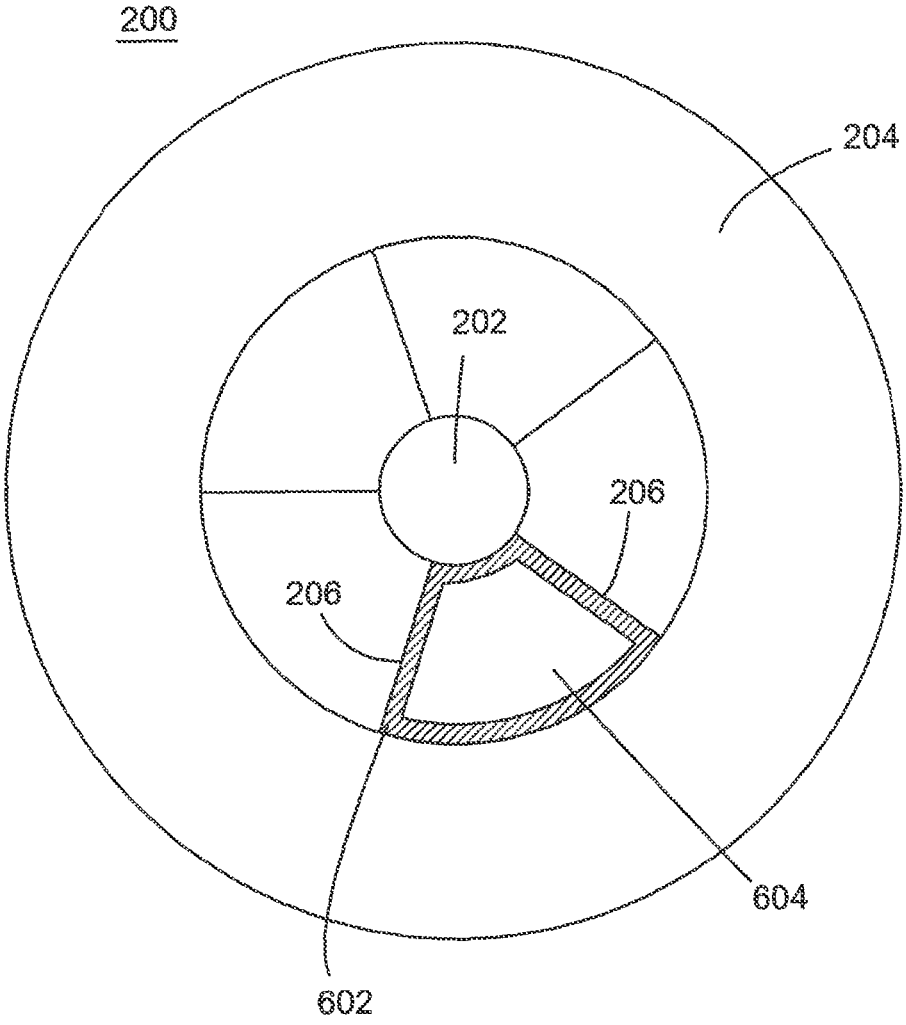
FIG. 6 shows an impeller, an insert and a metal powder according to exemplary embodiments.

When applying HIP to exemplary embodiments described herein, the powder metal HIP may consist of a sequence of procedures that start from metal powders and end up as a less porous, dense material. Pre-alloyed metal powders of steel, other corrosion resistant alloys or erosion resistant alloys can be injected inside a mild steel tool (or casing and/or insert) which has been properly created to fit the component geometry and deform as needed. An example of this is illustrated in FIG. 6, which shows the impeller 200, an insert 604 and a metal powder(s) 602 between portions of the impeller 200 and the insert 604. The insert 604 is then heated treated in a HIP furnace at temperatures generally in excess of 1100° C. at a pressure up to 1000 bars, however, according to other exemplary embodiments, for other materials other temperature and pressure combinations can be used. The metal powders 602 diffuse among each other (or the metal powders 602 diffuse among each other and into a more solid base metal) resulting in a strong metallurgical bond wherein the metal powders 602 in the tool 604 have a porosity of generally less than 1% of their original porosity. A chemical etching, e.g., an acid etching, or a mechanical milling is then used to remove the tool 604. This HIP process can also be used to join two solid pieces by using a metal powder between the two solid pieces, and then following the HIP process. For this exemplary case, depending upon the geometry of the parts, either a single insert or multiple inserts may be used. According to exemplary embodiments described below, HIP can be used to form an impeller, parts of an impeller, create resistant layers on surfaces of an impeller which may be exposed to corrosive process gases, to join components of an impeller together and various combinations of these options.

Figure 7:
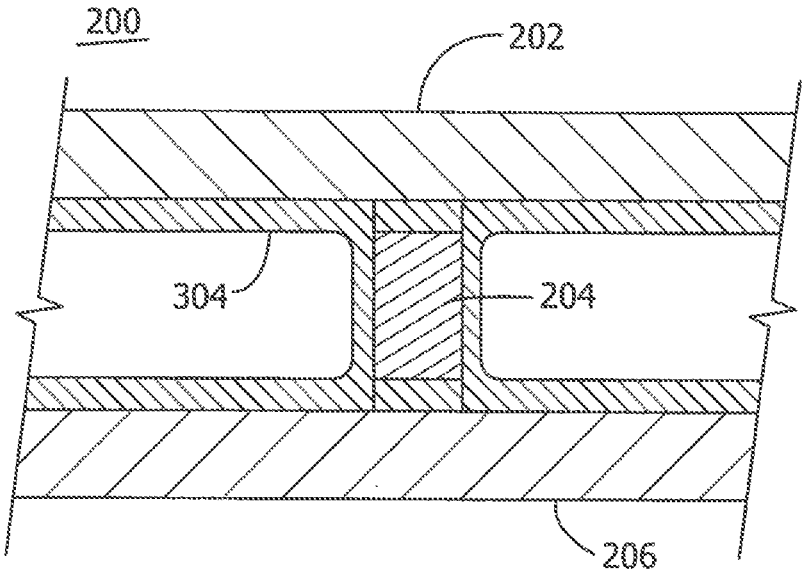
FIG. 7 shows a separate yet attached disk, blade and counter disk with an external layer according to an exemplary embodiment.

According to an exemplary embodiment as shown in FIG. 7, using the exemplary methods and systems described above, the impeller 200 can include a disk section 202, a counter disk section 206 and a blade section 204, each of which is separately manufactured from the base metal. These components can be manufactured by traditional manufacturing methods, or by using HIP with powder metal. The components can then be joined together via a hot isostatic pressing such that a protective alloy layer 304 is also formed. The protective allow layer 304 can include intermediate and external layers. In this case, the protective layer 304 both protects the base material and joins the blades to the disk section 202 and the counter disk section 204.

Figure 8:
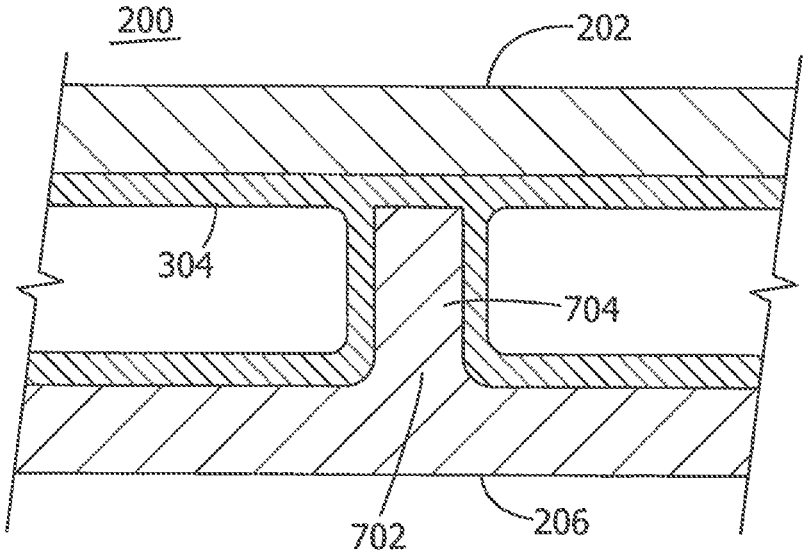
FIG. 8 depicts an integrated blade and counter disk attached to the disk and an external layer according to exemplary embodiments.

According to an exemplary embodiment as shown in FIG. 8, using the exemplary methods and systems described above, the impeller 200 includes a disk section 202, a counter disk section 206 and a blade section 204. The counter disk section 206 and the blade section 204 are a single integrated piece and the disk section 202 is a separate single piece. These two sections are joined together via a hot isostatic pressing such that a protective alloy layer 304 is also formed. The protective allow layer 304 can include intermediate and external layers.

Figure 9:
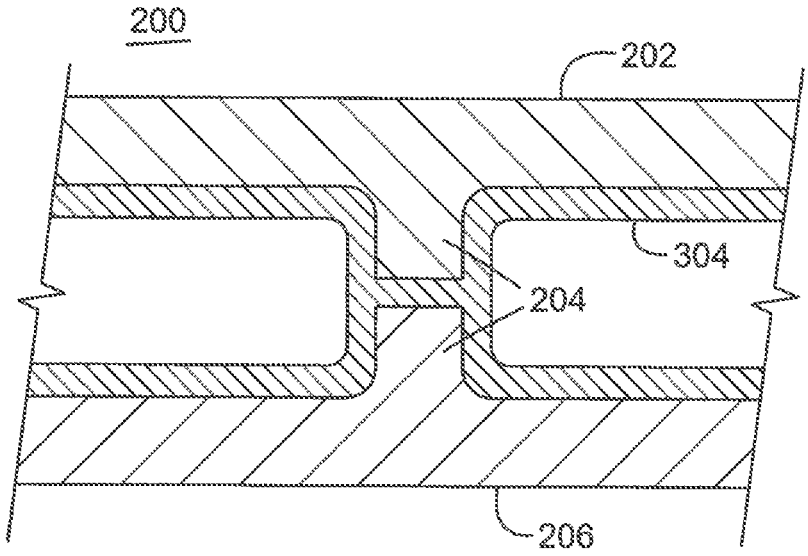
FIG. 9 shows a split blade with a portion of the blade integrated with the disk, and a second portion of the blade integrated with the counter disk and an external layer according to exemplary embodiments.

According to an exemplary embodiment as shown in FIG. 9, using the exemplary methods and systems described above, the impeller 200 includes a disk section 202, a counter disk section 206 and a blade section 204. The disk section 202 is formed integrally with a portion of a plurality of blades and the counter disk section 206 is formed integrally with another portion of the plurality of blades. These two sections are joined together via a hot isostatic pressing such that a protective alloy layer 304 is also formed. The protective allow layer 304 can include intermediate and external layers.

Figure 10:
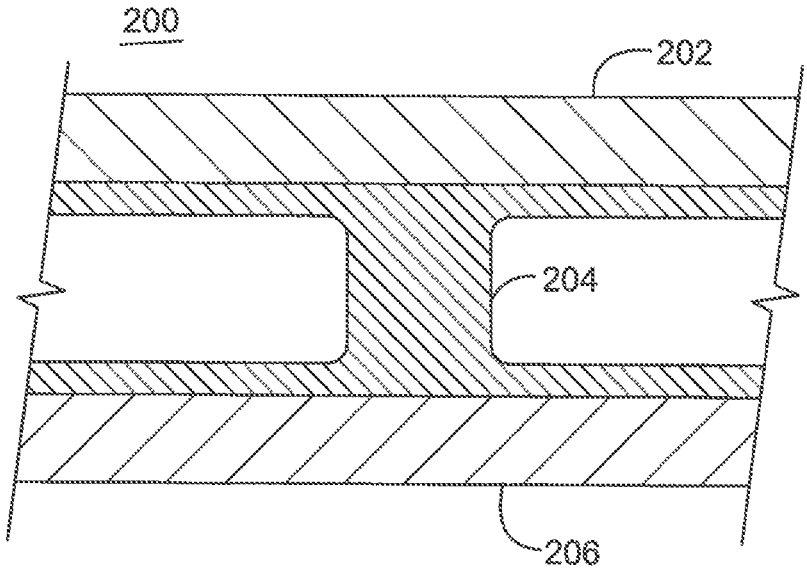
FIG. 10 shows the blade integrated with the external layer attached to the disk and the counter disk according to exemplary embodiments.

According to an exemplary embodiment as shown in FIG. 10, using the exemplary methods and systems described above, the impeller 200 includes a disk section 202, a counter disk section 206 and a blade section 204. The blade section integrally includes a surface covering for both an exterior surface of the disk section and an interior section of the counter disk section. The surface covering and blade section 204 is made from a corrosion resistant material and attached to the disk section 202 and the counter disk section 206 via a hot isostatic pressing.

Figure 11:
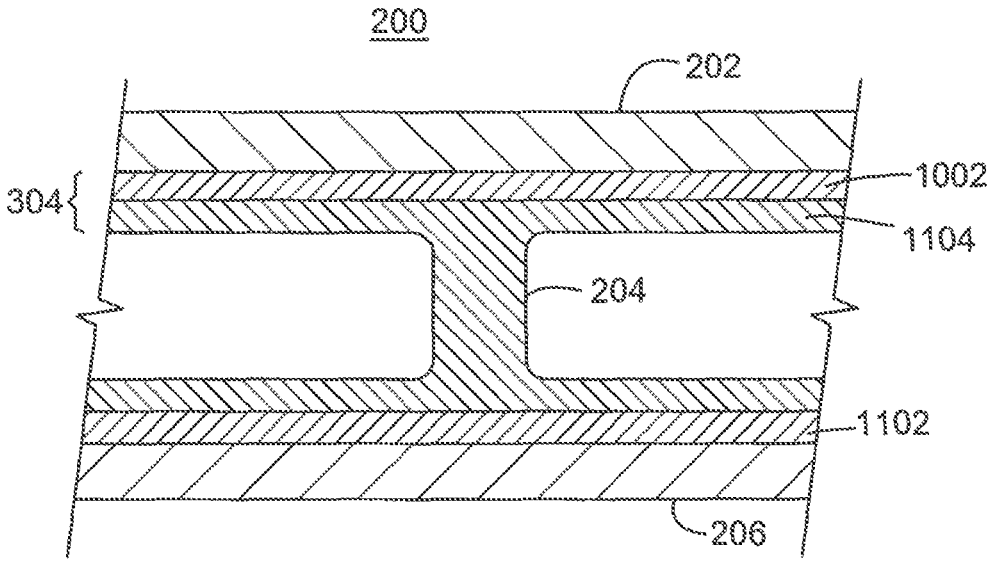
FIG. 11 shows an impeller with an intermediate layer and an external layer according to exemplary embodiments.

According to an exemplary embodiment, as described above the protective alloy layer 304 can include the intermediate and external layers. An example of this is shown in FIG. 11, which shows the impeller 200. The impeller 200 includes a disk section 202, a counter disk section 206, an intermediate layer 1102 and an external layer 1104 which includes the blade 204. While shown with two layers to the protective alloy layer 304 and the blade 204 as a part of the exterior layer 1004 various other combinations are possible. For example, two layers, three layers or more can be used in a HIP process with the various exemplary embodiments described herein for manufacturing an impeller. The two or more layers may have a composition that varies as shown in FIGS. 4 and 5.

According to alternative exemplary embodiments, one or more layers can be applied to an insert using various manufacturing techniques, e.g., spray coating, high velocity oxygen fuel (HVOF) thermal spray, plasma spray and brazing, with the first layer having the desired material properties, e.g., corrosion resistance. Other layers can be applied to the first layer, with each layer having a different material composition, such that the last layer, when undergoing HIP, will have the desired bond strength with the base metal to which it is attached during the HIP process. This alternative exemplary embodiment allows for another method for manufacturing an impeller for use in a compressor which uses the process gases described above. Additionally, when undergoing HIP, the desired densification, i.e., reduction of porosity in the added layers, will occur to obtain the desired geometry for the impeller.

According to exemplary embodiments, the exemplary systems and methods described herein can create a desirable process capability when manufacturing an impeller using HIP. These manufacturing processes are not restrictive based on part geometry as is often the case when spray coating layers onto a complex surface, e.g., a blade. Additionally, through the exemplary HIP process, the insert is deformed and not the parts of the impeller 200, which allows the layer deposition to be in the final geometry of the impeller 200. The outer protective alloy layer 304 can be designed as needed based on the expected process gas to be used in the compressor. These exemplary systems and methods allow for protection of the parts where needed, a lower material cost as compared to traditional impellers used in the environments described herein, a lower manufacturing lead time, and desired tolerance control.

While HIP has been described as the joining process for the exemplary embodiments described above, other joining processes can, in some cases, be used. For example, other forms of powdered metal joining, e.g., sintering brazing, arc welding, friction welding, diffusion bonding and diffusion brazing, can, in some cases, be used to join the base metal pieces when they are formed separately.

Figure 12:
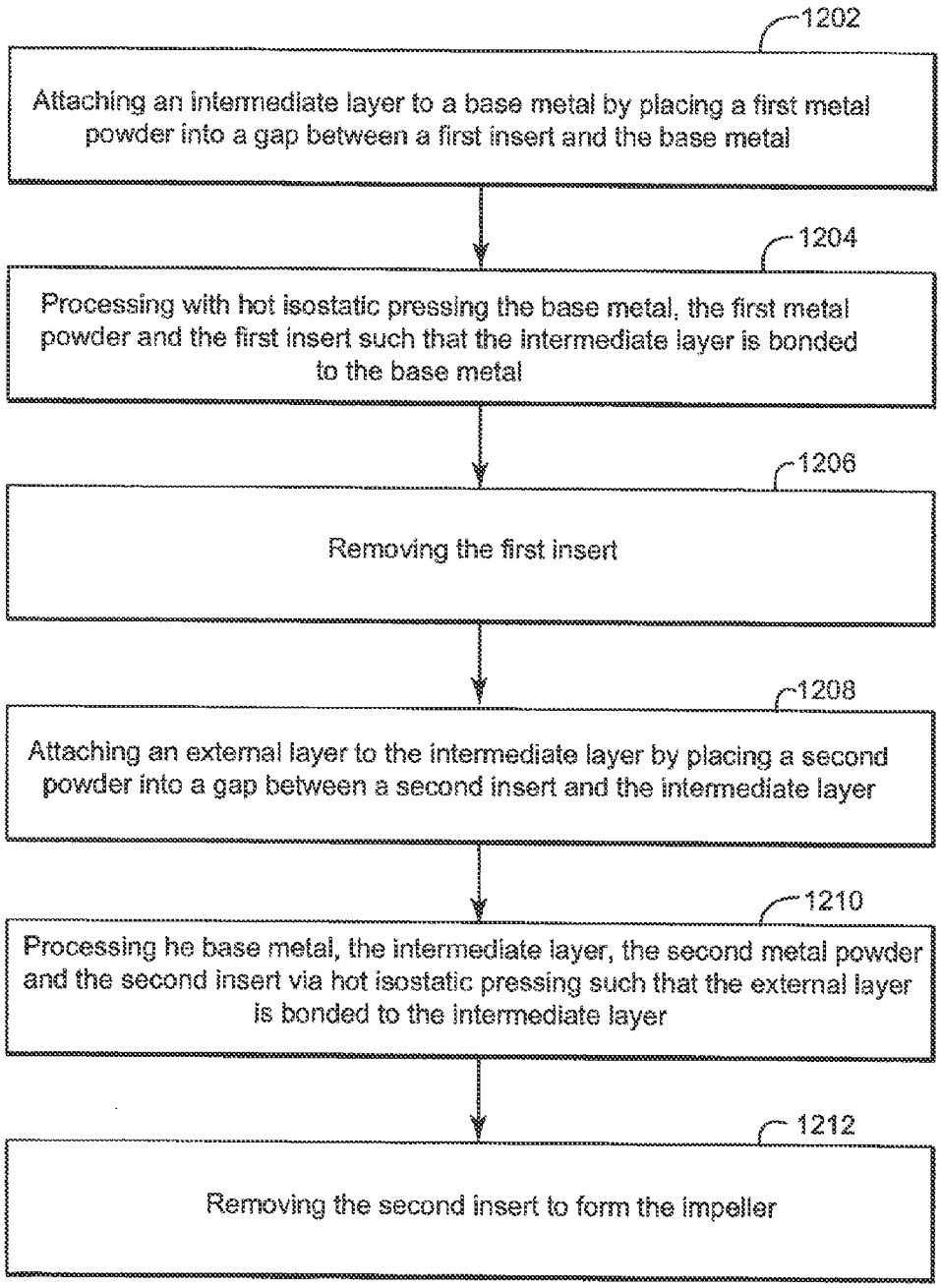
FIG. 12 is a flowchart showing a method for manufacturing an impeller according to exemplary embodiments.

Utilizing the above-described exemplary systems according to exemplary embodiments, a method for manufacturing an impeller is shown in the flowchart of FIG. 12. A method for manufacturing an impeller to be used in a compressor which uses a corrosive process gas includes: a step 1202 of attaching an intermediate layer to a base metal by placing a first metal powder into a gap between a first insert and the base metal; a step 1204 of processing with hot isostatic pressing the base metal, the first metal powder and the first insert such that the intermediate layer is bonded to the base metal; a step 1206 of removing the first insert; a step 1208 of attaching an external layer to the intermediate layer by placing a second powder into a gap between a second insert and the intermediate layer; a step 1210 of processing the base metal, the intermediate layer, the second metal powder and the second insert via hot isostatic pressing such that the external layer is bonded to the intermediate layer; and a step 1212 of removing the second insert to form the impeller.

Figure 13:
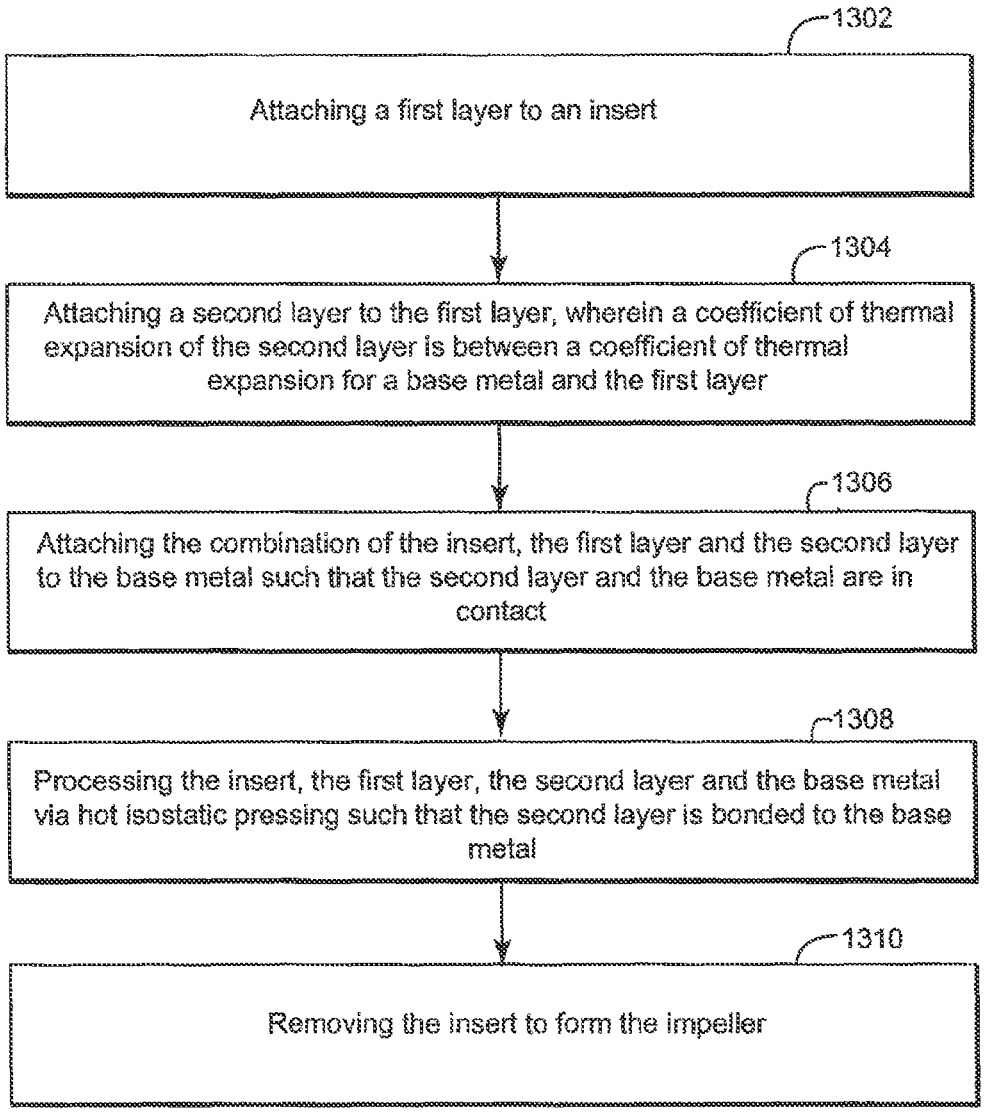
FIG. 13 is a flowchart showing another method for manufacturing an impeller according to exemplary embodiments.

Utilizing the above-described exemplary systems according to exemplary embodiments, another method for manufacturing an impeller is shown in the flowchart of FIG. 13. A method for manufacturing an impeller to be used by a compressor which uses a corrosive process gas includes: a step 1302 of attaching a first layer to an insert; a step 1304 of attaching a second layer to the first layer, where a coefficient of thermal expansion of the second layer is between a coefficient of thermal expansion for a base metal and the first layer; a step 1306 of attaching a combination of the insert, the first layer and the second layer to the base metal such that the second layer and the base metal are in contact; a step 1308 of processing the insert, the first layer, the second layer and the base metal via hot isostatic pressing such that the second layer is bonded to the base metal; and a step 1310 of removing the insert to form the impeller.

Figure 1:
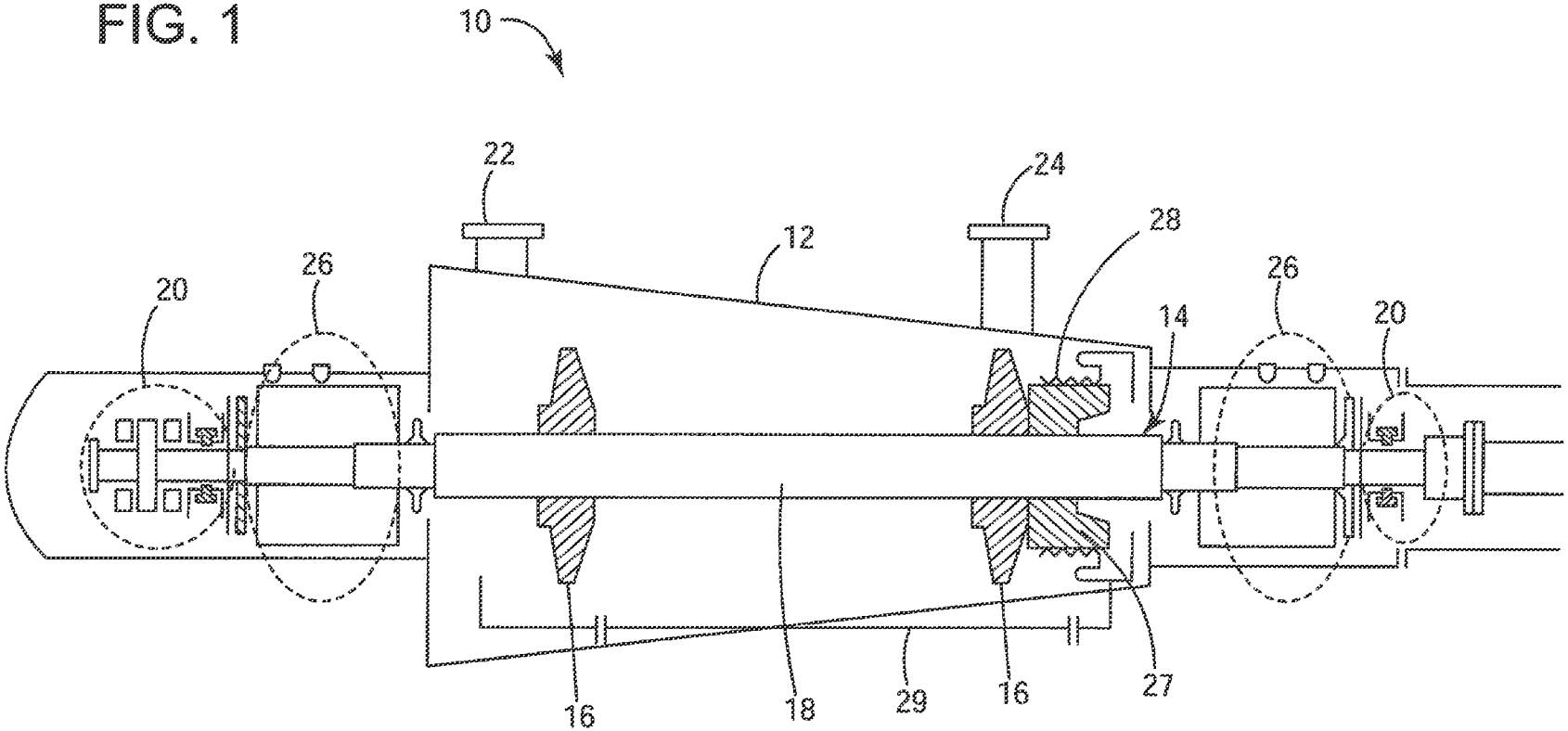
FIG. 1 depicts a compressor.

The above-described exemplary embodiments are intended to be illustrative in all respects, rather than restrictive, of the present invention. Thus the present invention is capable of many variations in detailed implementation that can be derived from the description contained herein by a person skilled in the art. For example, the exemplary impellers described herein could be used in a compressor (or turbo machine) as shown in FIG. 1, or other compressors which use impellers. All such variations and modifications are considered to be within the scope and spirit of the present invention as defined by the following claims. No element, act, or instruction used in the description of the present application should be construed as critical or essential to the invention unless explicitly described as such. Also, as used herein, the article "a" is intended to include one or more items. This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

The invention claimed is:

1. An impeller for use in a compressor, the impeller comprising:

a disk section which is made from a carbon steel;

a counter disk section which is made from the carbon steel;

a plurality of blades made from the carbon steel in contact with the disk section and the counter disk section;

an intermediate layer attached on surfaces which are in a process gas flow path of the disk section, the counter disk section and the plurality of blades, wherein the intermediate layer is attached via a hot isostatic pressing, resulting in a porosity of generally less than one percent and a coefficient of thermal conductivity between a coefficient of thermal conductivity for the carbon steel and an external layer; and an external layer attached to the intermediate layer via a hot isostatic pressing, the external layer having a porosity less than once percent after hot isostatic pressing and being corrosion resistant.

2. A method for manufacturing an impeller to be used by a compressor, the method comprising:

attaching a first layer to an insert, wherein the first layer is corrosion resistant after hot isostatic pressing;

attaching a second layer to the first layer, wherein a coefficient of thermal expansion of the second layer is between a coefficient of thermal expansion for a base metal and the first layer;

attaching a combination of the insert, the first layer and the second layer to the base metal such that the second layer and the base metal are in contact;

processing the insert, the first layer, the second layer and the base metal via hot isostatic pressing such that the second layer is bonded to the base metal, the first layer and the second layer are bonded and both the first layer and the second layer have a porosity of generally less than one percent; and removing the insert to form the impeller.

3. A method for manufacturing an impeller to be used in a compressor, the method comprising:

attaching an intermediate layer to a base metal by placing a first metal powder into a gap between a first insert and the base metal;

processing with hot isostatic pressing the base metal, the first metal powder and the first insert such that the intermediate layer is bonded to the base metal, the intermediate layer having a porosity of generally less than one percent, wherein a coefficient of thermal expansion of the intermediate layer is between a coefficient of thermal expansion for the base metal and an external layer;

removing the first insert;

attaching an external layer to the intermediate layer by placing a second powder into a gap between a second insert and the intermediate layer;

processing the base metal, the intermediate layer, the second metal powder and the second insert via hot isostatic pressing such that the external layer is bonded to the intermediate layer, the external layer having a porosity of generally less than one percent; and removing the second insert to form the impeller, wherein the external layer is corrosion resistant after the hot isostatic pressing.

4. The method of claim 3, wherein the intermediate layer and the external layer have a coefficient of thermal expansion which varies as a distance of the intermediate and the external layers from the base metal varies.

5. The method of claim 3, further comprising:

forming the intermediate layer to include at least two layers, each of the two layers having a different coefficient of thermal expansion.

6. The method of claim 3, wherein the impeller includes a disk section, a counter disk section and a plurality of blades, all of which are formed from a single integrated piece of the base metal.

7. The method of claim 3, wherein the impeller includes a disk section, a counter disk section and a plurality of blades, each of which is separately manufactured from the base metal and joined together via a hot isostatic pressing such that the intermediate and external layers are formed there between.

8. The method of claim 3, wherein the impeller includes a disk section, a counter disk section and a plurality of blades, the counter disk section and the plurality of blades are a single integrated piece and the disk section is a single piece which are joined together via a hot isostatic pressing such that the intermediate and external layers are formed there between.

9. The method of claim 3, wherein the impeller includes a disk section, a counter disk section and a plurality of blades, the disk section is formed integrally with a portion of the plurality of blades and the counter disk section is formed integrally with another portion of the plurality of blades which are joined together via a hot isostatic pressing such that the intermediate and external layers are formed there between.

10. The method of claim 3, wherein the impeller includes a disk section, a counter disk section and a plurality of blades, the plurality of blades include a surface covering both an exterior surface of the disk section and an interior section of the counter disk section, are made from a corrosion resistant material and attached to the disk section and the counter disk section via a hot isostatic pressing.

* * * * *